US012258962B2

(12) United States Patent
Suo et al.

(10) Patent No.: US 12,258,962 B2
(45) Date of Patent: Mar. 25, 2025

(54) SCROLL COMPRESSOR AND AIR CONDITIONING SYSTEM WITH AN EXHAUST PIPE THAT AIDS IN OIL SEPERATION AND MOTOR COOLING

(71) Applicant: GUANGDONG MIDEA ENVIRONMENTAL TECHNOLOGIES CO., LTD., Guangdong (CN)

(72) Inventors: Wenping Suo, Guangdong (CN); Shenglin He, Guangdong (CN)

(73) Assignee: GUANGDONG MIDEA ENVIRONMENTAL TECHNOLOGIES CO., LTD., Guangdong (CN)

( * ) Notice: Subject to any disclaimer, the term of this patent is extended or adjusted under 35 U.S.C. 154(b) by 0 days.

(21) Appl. No.: 18/237,156

(22) Filed: Aug. 23, 2023

(65) Prior Publication Data

US 2023/0392597 A1 Dec. 7, 2023

Related U.S. Application Data

(63) Continuation of application No. PCT/CN2022/079953, filed on Mar. 9, 2022.

(30) Foreign Application Priority Data

Jan. 27, 2022 (CN) ..... 202210101544.1

(51) Int. Cl.
*F04C 18/02* (2006.01)
*F04C 29/02* (2006.01)
*F04C 29/12* (2006.01)

(52) U.S. Cl.
CPC ..... *F04C 18/0215* (2013.01); *F04C 29/026* (2013.01); *F04C 29/12* (2013.01); *F04C 2240/806* (2013.01); *F04C 2240/807* (2013.01)

(58) Field of Classification Search
CPC .... F04C 18/0215; F04C 29/026; F04C 29/12; F04C 2240/806; F04C 2240/807
See application file for complete search history.

(56) References Cited

U.S. PATENT DOCUMENTS

2019/0271311 A1 9/2019 Choi et al.

FOREIGN PATENT DOCUMENTS

CN 107061269 A 8/2017
CN 108286521 A 7/2018
(Continued)

OTHER PUBLICATIONS

Chinese Patent Publication and Machine Translation for CN 215373036 U: 1st Inventor: Cui; Title: Compressor Air Inlet Pip, Compressor and Air Conditioner; Published: Dec. 31, 2021. (Year: 2021).*
(Continued)

*Primary Examiner* — Mary A Davis
(74) *Attorney, Agent, or Firm* — Scully, Scott, Murphy & Presser, P.C.

(57) ABSTRACT

A scroll compressor and an air conditioning system are provided. The scroll compressor has a housing, a compression mechanism portion, a main frame, a motor, a crankshaft, a main balancing block and an exhaust pipe. In a radial direction of the housing, the exhaust pipe extends into the housing at a depth W, and an outer peripheral wall of the main balancing block is located at a distance L from an inner wall of the housing, where $0.47 \leq W/L \leq 0.93$. In this way, a part of a high-pressure oil-gas mixture generated by the compression mechanism portion is discharged through cyclone separation of the main balancing block and mechanical separation of the housing; and the other part of the high-pressure oil-gas mixture flows into an axial channel to achieve oil and gas separation while cooling the motor, and is subsequently discharged.

16 Claims, 6 Drawing Sheets

(56) References Cited

FOREIGN PATENT DOCUMENTS

| | | | |
|---|---|---|---|
| CN | 108286522 | A | 7/2018 |
| CN | 109404289 | A | 3/2019 |
| CN | 112879286 | A | 6/2021 |
| CN | 215409185 | U | 1/2022 |
| CN | 216665913 | U | 6/2022 |
| EP | 3670918 | A1 | 6/2020 |
| JP | H0626484 | A | 2/1944 |
| JP | 2002317775 | A | 10/2002 |
| JP | 2005163687 | A | 6/2005 |
| JP | 2020531728 | A | 11/2020 |

OTHER PUBLICATIONS

Korean Patent Publication with Machine Translation for KR 10-049373 B1; Title: Discharge Pipe Connection Structure for Scroll Compressor; Published Nov. 19, 2002. (Year: 2002).*

Chinese Patent Publication and Machine Translation for CN 107806409 A; 1st Inventor: Hu; Title: A Compressor; Published: Mar. 16, 2018. (Year: 2018).*

Notice of Reasons for Refusal dated Jul. 30, 2024 received in Japanese Patent Application No. 2023-558867.

Supplementary European search report dated Jun. 27, 2024 received in European Patent Application No. 22919301.6.

Written Opinion dated Jul. 29, 2022 received in International Application No. PCT/CN2022/079953.

International Search Report dated Jul. 29, 2022 issued in PCT/CN2022/079953.

First Office Action dated Dec. 12, 2024 received in Chinese Patent Application No. 202210101544. 1.

Notice of Reasons for Refusal dated Jan. 21, 2025 received in Japanese Patent Application No. 2023-558867.

* cited by examiner

SCROLL COMPRESSOR AND AIR CONDITIONING SYSTEM WITH AN EXHAUST PIPE THAT AIDS IN OIL SEPERATION AND MOTOR COOLING

CROSS-REFERENCE TO RELATED APPLICATIONS

The present application is a continuation application of International Application No. PCT/CN2022/079953, filed on Mar. 9, 2022, which claims priority to Chinese Patent Application No. 202210101544.1, titled "SCROLL COMPRESSOR AND AIR CONDITIONING SYSTEM" and filed with China National Intellectual Property Administration on Jan. 27, 2022, the entire contents of each of which are incorporated herein by reference for all purposes. No new matter has been introduced.

FIELD

The present disclosure relates to the field of compressor technologies, and more particularly, to a scroll compressor and an air conditioning system.

BACKGROUND

The statements herein provide only background information relevant to the present disclosure and do not necessarily constitute the related art. When a scroll compressor is in operation, a mixture of a refrigerant and oil entering from a suction pipe is compressed into a high-pressure oil-gas mixture by a compressor cavity formed by a cooperation between a static scroll and an orbiting scroll. At present, an exhaust pipe of the scroll compressor is disposed on a housing between a main frame and a stator, which leads to discharge of a part of the above-mentioned high-pressure oil-gas mixture from the compressor without effective oil and gas separation, and the rest of the above-mentioned high-pressure oil-gas mixture is discharged from the compressor without effective secondary separation from a wall surface of the housing after entry into a chamber between the main frame and the stator, resulting in a high oil circulation rate in total exhaust of the compressor. The high oil circulation rate leads to a low efficiency of an air conditioning system on the one hand, and affects reliability of the compressor and the air conditioning system on the other hand.

SUMMARY

Embodiments of the present disclosure aim to provide a scroll compressor, to solve at least the problem in the related art that a high oil circulation rate resulted from poor oil and gas separation of a high-pressure oil-gas mixture in the scroll compressor affects reliability of the compressor and an air conditioning system, and reduces an efficiency of the air conditioning system.

The embodiments of the present disclosure adopt the following technical solutions.

According to an embodiment, a scroll compressor is provided. The scroll compressor. The scroll compressor includes a housing, a compression mechanism portion, a main frame, a motor, a crankshaft, a main balancing block, and an exhaust pipe. The main frame is located between the compression mechanism portion and the motor. The main balancing block is arranged around the crankshaft and located between the motor and the main frame. An end of the exhaust pipe extends into the housing towards an outer peripheral wall of the main balancing block, and is located between the main frame and the motor. In a radial direction of the housing, the exhaust pipe extends into the housing at a depth W, and the outer peripheral wall of the main balancing block is located at a distance L from an inner wall of the housing, where $0.47 \leq W/L \leq 0.93$.

In some embodiments, the motor includes a rotor and a stator. The crankshaft passes through the rotor and is connected to the compression mechanism portion. The stator is mounted in the housing and includes an iron core mounted in the housing. In an axial direction of the crankshaft, a lower end surface of the main frame is located at a distance H from an upper end surface of the iron core, and a central axis of the exhaust pipe is located at a distance h from the upper end surface of the iron core, where $0.17 \leq h/H \leq 0.62$.

In some embodiments, a segment of the exhaust pipe adjacent to the crankshaft is a tapered pipe segment, an inner diameter of an end of the tapered pipe segment adjacent to the crankshaft being smaller than an inner diameter of another end of the tapered pipe segment.

In some embodiments, the end of the tapered pipe segment adjacent to the crankshaft has a cross-sectional area Si, and the other end of the tapered pipe segment facing away from the crankshaft has a cross-sectional area So, where $0.50 \leq Si/So \leq 1.00$.

In some embodiments, the exhaust pipe includes a straight pipe segment penetrating the housing.

In some embodiments, a positioning structure is disposed on the straight pipe segment, the positioning structure being configured to stop and position the exhaust pipe to restrict the depth of extension of the exhaust pipe into the housing, and the positioning structure being located on an outer peripheral surface of the straight pipe segment.

In some embodiments, the positioning structure is a rib ring disposed on the straight pipe segment, or the positioning structure includes one or more positioning protrusions disposed on the outer peripheral surface of the straight pipe segment.

In some embodiments, the positioning structure is an annular base disposed on the straight pipe segment, the annular base being connected to an outer surface of the housing through welding.

In some embodiments, an end surface of the annular base adjacent to the housing has a circular arc surface adapted to the outer surface of the housing.

In some embodiments, the outer surface of the housing has a stamping welding flat surface, and an end surface of the annular base adjacent to the housing has a flat surface adapted to the stamping welding flat surface of the housing.

In some embodiments, the positioning structure and the straight pipe segment are integrally formed, or the positioning structure is welded on the straight pipe segment.

According to an embodiment, an air conditioning system is provided. The air conditioning system includes the scroll compressor according to any one of the embodiments as described above.

The scroll compressor according to the embodiments of the present disclosure has the following advantageous effects. With the scroll compressor according to the embodiments of the present disclosure, the depth of the exhaust pipe extending into the housing is set to 0.47 times to times of a distance between an outer peripheral wall of the main balancing block and the inner wall of the housing. In this way, a part of a high-pressure oil-gas mixture discharged from the compression mechanism portion flows into the exhaust pipe through cyclone separation generated by a rotation of the main balancing block and mechanical separation of the housing, and then and is discharged from the exhaust pipe, and the other part of the high-pressure oil-gas mixture flows into an axial channel, such as a gap between the stator and the rotor, to realize oil and gas separation while cooling the motor, and then is discharged from the exhaust pipe. Thus, sufficient oil and gas separation can be performed on a gas entering the exhaust pipe to reduce the oil circulation rate, improving the reliability of the scroll compressor, and enhancing the reliability and efficiency of the air conditioning system using the scroll compressor.

The air conditioning system according to the embodiments of the present disclosure has the following advantageous effects. The air conditioning system according to the embodiments of the present disclosure employs the scroll compressor according to the above-mentioned embodiments, and has technical effects of the above-mentioned scroll compressor, and details thereof will be omitted herein.

BRIEF DESCRIPTION OF THE DRAWINGS

In order to clearly explain technical solutions of embodiments of the present disclosure, drawings used in the description of the embodiments or exemplary technology are briefly described below. The drawings as described below are merely some embodiments of the present disclosure. Based on these drawings, other drawings can be obtained by those skilled in the art without creative effort.

Figure 1:
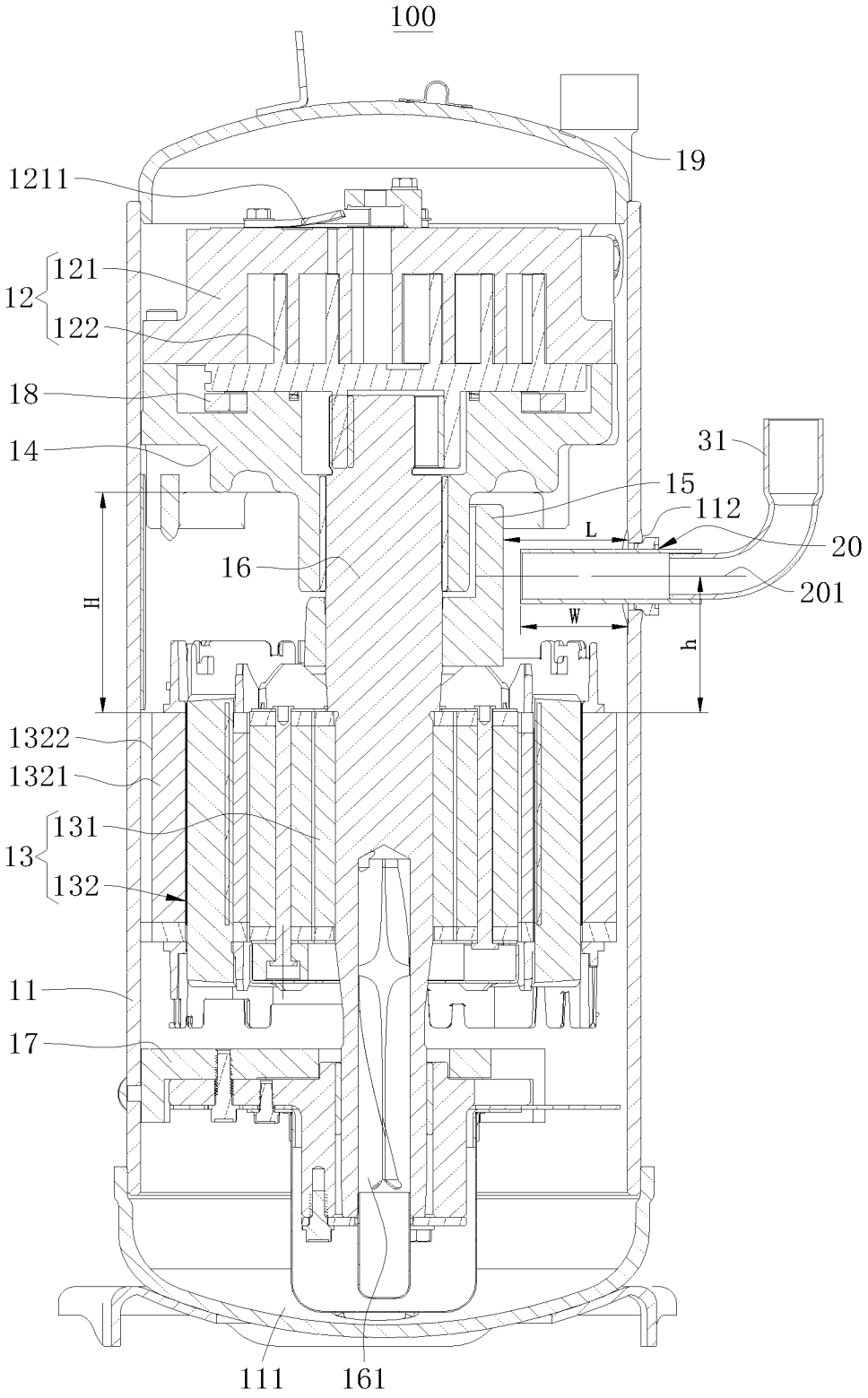
FIG. 1 is a schematic view of a cross-sectional structure of a scroll compressor according to an embodiment of the present disclosure.

Main reference numerals of the accompanying drawings:

100—scroll compressor;

11—housing; 111—lubricating oil pool; 112—stamping welding surface; 12—compression mechanism portion; 121—static scroll; 1211—exhaust valve; 122—orbiting scroll; 13—motor; 131—rotor; 132—stator; 1321—iron core; 1322—cut edge; 14—main frame; 15—main balancing block; 16—crankshaft; 161—oil pumping channel; 17—secondary frame; 18—cross slip ring; 19—suction pipe;

20—exhaust pipe; 201—central axis; 21—straight pipe segment; 22—tapered pipe segment; 23—positioning structure; 231—annular base; 232—rib ring; 233—positioning protrusion;

31—outer exhaust pipe.

DETAILED DESCRIPTION OF EMBODIMENTS

The present disclosure will be described in detail with reference to the accompanying drawings and embodiments. It should be understood that specific embodiments described here are only used to explain, rather than to limit, the present disclosure.

It should be noted that when an element is described as being "fixed to" or "disposed on" another element, it may be directly or indirectly on the other element. When an element is described as being "connected to" another element, it may be directly or indirectly connected to the other element.

In the description of the application, "plurality" means at least two, unless otherwise expressly and specifically limited. "A number of" means one or more, unless otherwise expressly and specifically limited. The orientation or position relationship indicated by the terms "center", "length", "width", "thickness", "upper", "lower", "front", "rear", "left", "right", "vertical", "horizontal", "top", "bottom", "inner", and "outer", etc. is based on the orientation or position relationship shown in the drawings, and is only for the convenience of describing the present disclosure and simplifying the description, rather than indicating or implying that the pointed device or element must have a specific orientation, or be constructed and operated in a specific orientation, and therefore cannot be understood as a limitation of the present disclosure.

In the description of the present disclosure, it should be noted that, unless otherwise clearly specified and limited, terms such as "install", "connect", "connect to", and the like should be understood in a broad sense. For example, it may be a fixed connection or a detachable connection or connection as one piece; mechanical connection or electrical connection; direct connection or indirect connection through an intermediate; internal communication of two components or the interaction relationship between two components. For those of ordinary skill in the art, the specific meaning of the above-mentioned terms in the present disclosure can be understood according to specific circumstances.

In the description of the specification, descriptions with reference to the terms "an embodiment", "some embodiments", or "embodiments" etc. mean that specific features, structures, or characteristics described in conjunction with the embodiment are included in one or more embodiments of the present disclosure. Thus, the phrases "in one embodiment", "in some embodiments", "in other embodiments", "in some other embodiments", or the like appearing in different places in the specification do not necessarily refer to the same embodiment, but mean "one or more but not all embodiments", unless otherwise specifically emphasized. In addition, the described specific features, structures, or characteristics may be combined in one or more embodiments in a suitable manner.

As illustrated in FIG. 1, a scroll compressor 100 according to an embodiment of the present disclosure will be described below. The scroll compressor 100 includes a housing 11, a compression mechanism portion 12, a main frame 14, a motor 13, a crankshaft 16, a main balancing block 15, and an exhaust pipe 20. The compression mechanism portion 12, the main frame 14, the motor 13, the crankshaft 16, and the main balancing block 15 are all mounted in the housing 11. Thus, the compression mechanism portion 12, the main frame 14, the motor 13, the crankshaft 16, and the main balancing block 15 can be protected by the housing 11. The exhaust pipe 20 is mounted at the housing 11 to enable the exhaust pipe 20 to be supported by the housing 11. The exhaust pipe 20 is configured to discharge a compressed high-pressure gas from the housing 11 for use.

The compression mechanism portion 12 is configured to compress a gas to generate a high-pressure gas. The compression mechanism portion 12 is located above the main frame 14 and is supported by the main frame 14. The motor 13 is configured to provide a driving power to drive an operation of the compression mechanism portion 12. The motor 13 is disposed below the main frame 14. The crankshaft 16 passes through the motor 13 and is connected to the compression mechanism portion 12. In this way, the motor 13 can drive the crankshaft 16 to rotate and thus, to drive the operation of the compression mechanism portion 12.

The main balancing block 15 is mounted on the crankshaft 16 and located between the motor 13 and the main frame 14. Thus, the main balancing block 15 may be driven by the crankshaft 16 to rotate to ensure a stable operation of the compression mechanism portion 12. The main balancing block 15 may further be configured to generate cyclones to perform oil and gas separation on a part of a high-pressure oil-gas mixture discharged from the compression mechanism portion 12.

The motor 13 includes a rotor 131, and a stator 132 mounted in the housing 11. The stator 132 is supported by the housing 11. The rotor 131 is mounted in the stator 132 and is driven by the stator 132 to rotate. The crankshaft 16 is connected to the rotor 131. The crankshaft 16 passes through the rotor 131, and is connected to the compression mechanism portion 12. In this way, when the rotor 131 is driven by the stator 132 to rotate, the crankshaft 16 may be driven to rotate, which in turn drives the operation of the compression mechanism portion 12.

An end of the exhaust pipe 20 extends into the housing 11. The exhaust pipe 20 is located between the main frame 14 and the stator 132. In the housing 11, there is a large space between the motor 13 and the main housing 11. The exhaust pipe 20 is disposed in this large space, which facilitates mounting of the exhaust pipe 20, and allows the exhaust pipe 20 to be inserted into the housing 11 at a deeper depth.

In a radial direction of the housing 11, the exhaust pipe 20 extends into the housing 11 at a depth W, and an outer peripheral wall of the main balancing block 15 is located at a distance L from an inner wall of the housing 11, where $0.47 \leq W/L \leq 0.93$. That is, assuming that in the radial direction of the housing 11, the exhaust pipe 20 extends into the housing 11 at the depth W, and the outer peripheral wall of the main balancing block 15 is located at the distance L from the inner wall of the housing 11, W/L ranging from 0.47 to 0.93. For example, a value of W/L may be 0.50, 0.53, 0.55, 0.57, 0.6, 0.63, 0.65, 0.67, 0.70, 0.73, 0.75, 0.77, 0.80, 0.83, 0.85, 0.87, 0.93, etc.

By setting W/L to a range from 0.47 to 0.93, a part of the high-pressure oil-gas mixture discharged from the compression mechanism portion 12 may be between the main frame 14 and the stator 132, and is subject to oil-gas separation through a cyclone generated by a rotation of the main balancing block 15. In addition, this part of the high-pressure oil-gas mixture may also collide with an inner wall of the housing 11, and flows under the guiding of the housing 11 to be subject to mechanical separation. The separated gas is discharged through the exhaust pipe 20. For example, the oil-gas mixture between the main frame 14 and the stator 132 is subject to primary separation with a high-speed rotation of the main balancing block 15. A size of an oil droplet and a proportion of oil droplets increase as a distance between the oil-gas mixture and the main balancing block 15 increases. Then, the oil-gas mixture adjacent to an inner wall surface of the housing 11 is subject to secondary separation with the collision with the housing 11 again. Since the housing 11 has a round shape, the oil-gas mixture is guided to rotate centrifugally, which can also realize the oil and gas separation to some extent. The separated gas is discharged from the exhaust pipe 20. The other part of the high-pressure oil-gas mixture flows into an axial channel, such as a gap between the stator 132 and the rotor 131 of the motor 13, to cool the motor 13. In addition, the oil and gas separation also occurs during the flowing of the oil-gas mixture. The separated gas is discharged through the exhaust pipe 20. In this way, more oil is separated from the high-pressure oil-gas mixture discharged from the compression mechanism portion 12. As a result, it is possible to reduce the oil content in the high-pressure gas discharged through the exhaust pipe 20, thereby decreasing an oil circulation rate. Further, reliability of the scroll compressor 100 can be improved, and reliability and an efficiency of an air conditioning system using the scroll compressor 100 can be enhanced.

Compared with a scroll compressor in the related art, with the scroll compressor 100 according to the embodiments of the present disclosure, the depth of the exhaust pipe 20 extending into the housing 11 is set as 0.47 times to 0.93 times of the distance between the outer peripheral wall of the main balancing block 15 and the inner wall of the housing 11. In this way, a part of the high-pressure oil-gas mixture discharged from the compression mechanism portion 12 flows into the exhaust pipe 20 through cyclone separation generated by the rotation of the main balancing block 15 and the mechanical separation of the housing 11. The other part of the high-pressure oil-gas mixture flows into the axial channel, such as the gap between the stator 132 and the rotor 131, to carry out the oil and gas separation while cooling the motor 13, and then is discharged from the exhaust pipe 20. Thus, sufficient oil and gas separation can be performed on a gas entering the exhaust pipe 20 to reduce the oil circulation rate, thereby improving the reliability of the scroll compressor 100 and enhancing the reliability and efficiency of the air conditioning system using the scroll compressor 100.

In an embodiment, the stator 132 includes an iron core 1321 mounted in the housing 11 and is supported by the housing 11. In an axial direction of the crankshaft 16, a lower end surface of the main frame 14 is located at a distance H from an upper end surface of the iron core 1321, and a central axis 201 of the exhaust pipe 20 is located at a distance h from the upper end surface of the iron core 1321, where $0.17 \leq h/H \leq 0.62$. In other words, the lower end surface of the main frame 14 is located at the distance H from the upper end surface of the iron core 1321 in the axial direction of the crankshaft 16, and the central axis 201 of the exhaust pipe 20 is at the distance h from the upper end surface of the iron core 1321 in the axial direction of the crankshaft 16. That is, in a height direction, the lower end surface of the main frame 14 is located at the distance H from the upper end surface of the iron core 1321, and the central axis 201 of the exhaust pipe 20 is located at the distance h from the upper end surface of the iron core 1321, where h/H ranges from 0.17 to 0.62. For example, a value of h/H may be 0.17, 0.20, 0.22, 0.25, 0.3, 0.32, 0.35, 0.37, 0.40, 0.42, 0.45, 0.47, 0.50, 0.52, 0.55, 0.57, 0.60, 0.62, etc.

By setting h/H to a range from 0.17 to 0.62, it is possible to allow more high-pressure oil-gas mixture discharged from the compression mechanism portion 12 to be subject to the sufficient oil and gas separation between the main frame 14 and the stator 132, which effectively prevents un-separated oil from flowing to the exhaust pipe 20 directly.

In addition, by setting W/L to a range from 0.47 to 0.93 and h/H to a range from 0.17 to 0.62, most of the high-pressure oil-gas mixture discharged from the compression mechanism portion 12 may be subject to the sufficient oil and gas separation between the main frame 14 and the stator 132, and the rest of the high-pressure oil-gas mixture may flow into the axial channel, such as the gap between the stator 132 and the rotor 131 of the motor 13, to cool the motor 13. In addition, when the high-pressure oil-gas mixture flows, the sufficient oil and gas separation is carried out. The separated gas is discharged through the exhaust pipe 20. In this way, more oil is separated from the high-pressure oil-gas mixture discharged from the compression mechanism portion 12. Therefore, the oil content in the high-pressure gas discharged from the exhaust pipe can be reduced, thereby reducing the oil circulation rate.

In an embodiment, as illustrated in FIG. 1, an outer peripheral surface of the stator 132 has a cut edge 1322. A separated lubricating oil may flow to a bottom of the housing 11 via a channel between the cut edge 1322 and the housing 11.

In an embodiment, as illustrated in FIG. 1, a suction pipe 19 is disposed on the housing 11 and connected to the compression mechanism portion 12 to provide suction, which facilitates compression of the compression mechanism portion 12.

In an embodiment, the compression mechanism portion 12 includes a static scroll 121 and an orbiting scroll 122. The static scroll 121 borders the main frame 14. The orbiting scroll 122 cooperates with the static scroll 121 to form a compressor cavity to compress the gas. The orbiting scroll 122 is connected to the crankshaft 16, and is driven by the crankshaft 16 to rotate for compressing the gas in cooperation with the static scroll 121.

In an embodiment, an exhaust valve 1211 is mounted on the static scroll 121 to discharge the compressed high-pressure oil-gas mixture into the housing 11 from the exhaust valve 1211.

In an embodiment, the exhaust valve 1211 is located at an end of the static scroll 121 facing away from the main housing 11. That is, the exhaust valve 1211 is located at a top end of the static scroll 121 to allow the high-pressure oil-gas mixture to be discharged towards the top of the housing 11. In this way, the high-pressure oil-gas mixture first collides with the top of the housing 11 to separate the oil and gas. In addition, a flow path of the high-pressure oil-gas mixture in the housing 11 can be lengthened to facilitate the oil and gas separation of the high-pressure oil-gas mixture during the flowing of the high-pressure oil-gas mixture and enhance an effect of the oil and gas separation.

In an embodiment, the scroll compressor 100 further includes a cross slip ring 18 connecting the orbiting scroll 122 to the main frame 14. That is, the orbiting scroll 122 is supported on the main frame 14 by the cross slip ring 18 to reduce a friction between the orbiting scroll 122 and the main frame 14 and reduce wear of the orbiting scroll 122, to protect the orbiting scroll 122. In addition, the cross slip ring 18 can also effectively reduce or avoid a rotation of the orbiting scroll 122 relative to the static scroll 121 to improve a compression efficiency.

In an embodiment, the scroll compressor 100 further includes a secondary frame 17. The secondary frame 17 is mounted in the housing 11, and located at a side of the motor 13 facing away from the main frame 14. That is, the secondary frame 17 is located below the motor 13. A lower end of the crankshaft 16 penetrates the secondary frame 17, through which the crankshaft 16 is positioned and supported to guide the rotation of the crankshaft 16, which reduces vibrations of the rotation of the crankshaft 16.

In an embodiment, a lubricating oil pool 111 is formed at a bottom of the housing 11. A lower end of the crankshaft 16 extends into the lubricating oil pool 111. An oil pumping channel 161 is formed in the crankshaft 16 to facilitate pumping of the lubricating oil.

In an embodiment, an end of the exhaust pipe 20, which extends out of the housing, 11 is connected to an outer exhaust pipe 31 to facilitate a connection to and use of an external device.

Figure 2:
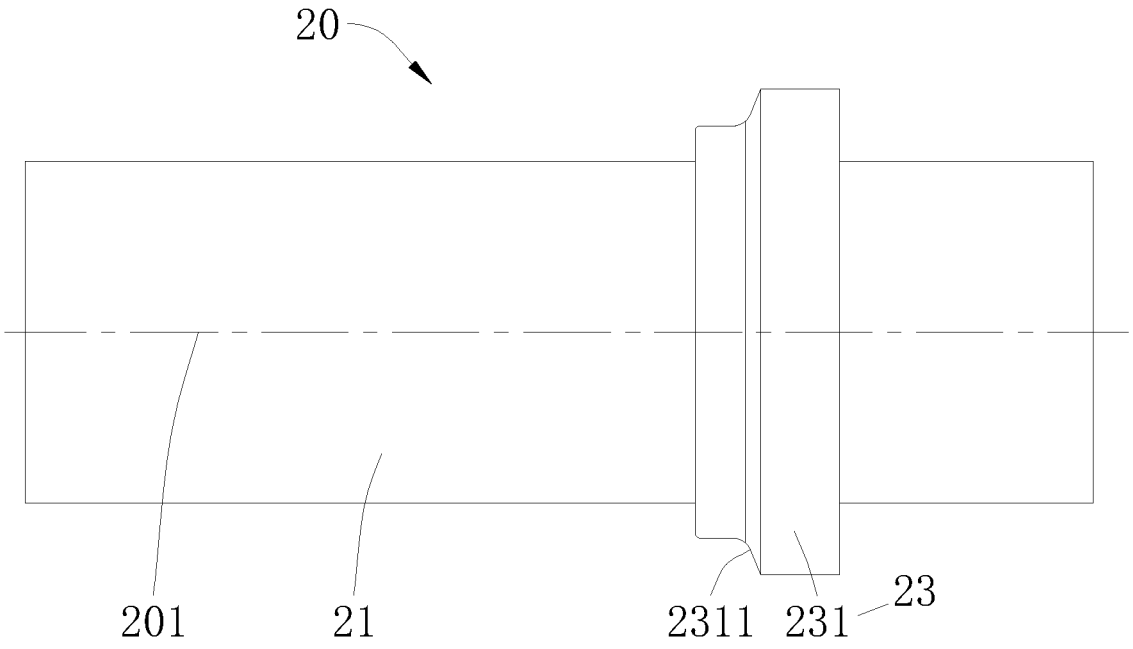
FIG. 2 is a schematic structural view of an exhaust pipe in FIG. 1.
Figure 3:
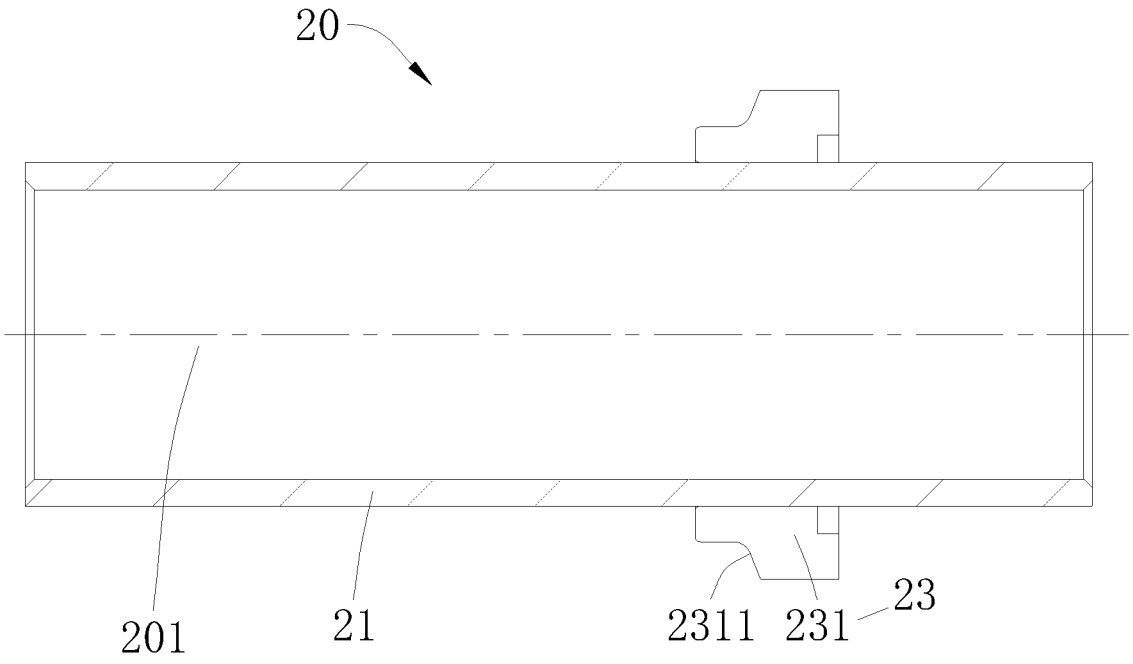
FIG. 3 is a schematic view of a cross-sectional structure of the exhaust pipe in FIG. 2.

In an embodiment, as illustrated in FIG. 1, FIG. 2, and FIG. 3, the exhaust pipe 20 includes a straight pipe segment 21 connected to the housing 11. The straight pipe segment 21 is provided to facilitate a connection to the housing 11, which facilitates the connection to the housing 11 through welding.

In an embodiment, the entire exhaust pipe 20 is straight to facilitate processing and manufacturing and reduce costs.

In an embodiment, a positioning structure 23 is disposed on the straight pipe segment 21 and located on an outer side surface of the straight pipe segment 21. When the straight pipe segment 21 is inserted into the housing 11, the positioning structure 23 can provide stopping and positioning. That is, the positioning structure 23 can be configured to stop and position an outer surface of the housing 11 to restrict an insertion depth of the exhaust pipe 20 into the housing 11, which facilitates assembly of the exhaust pipe 20.

In an embodiment, the positioning structure 23 may be an annular base 231 disposed on the straight pipe segment 21. When the exhaust pipe 20 is inserted into the housing 11, the annular base 231 abuts the outer surface of the housing 11 to restrict the insertion depth of the exhaust pipe 20 into the housing 11. The annular base 231 is connected to the outer surface of the housing 11 through welding to fixedly connect the exhaust pipe 20 to the housing 11, which facilitates assembly and connection.

In an embodiment, the outer surface of the housing 11 includes a stamping welding flat surface 112, and an end surface 2311 of the annular base 231 adjacent to the housing 11 is a flat surface. In this way, during assembly, the end surface of the annular base 231 adjacent to the housing 11 abuts the stamping welding flat surface 112 of the housing 11 to be better attached to the stamping welding flat surface 112, which facilitates welding to the housing 11.

It should be understood that, when the outer surface of the housing 11 is a circular arc surface, an end surface of the annular base 231 adjacent to the housing 11 has a circular arc surface adapted to the outer surface of the housing 11. In this way, during the assembly, the end surface of the annular base 231 adjacent to the housing 11 is better attached to the outer surface of the housing 11, which facilitates welding to the housing 11.

In an embodiment, the positioning structure 23 and the straight pipe segment 21 are integrally formed, which facilitates the processing and manufacturing to ensure sufficient connection strength between the positioning structure 23 and the straight pipe segment 21. For example, when the positioning structure 23 is the annular base 231, the annular base 231 and the straight pipe segment 21 are integrally formed.

It should be understood that, the positioning structure 23 may also be welded to the straight pipe segment 21. For example, when the positioning structure 23 is the annular base 231, the annular base 231 and the straight pipe segment 21 are manufactured separately, and the annular base 231 is then welded to the straight pipe segment 21.

Figure 4:
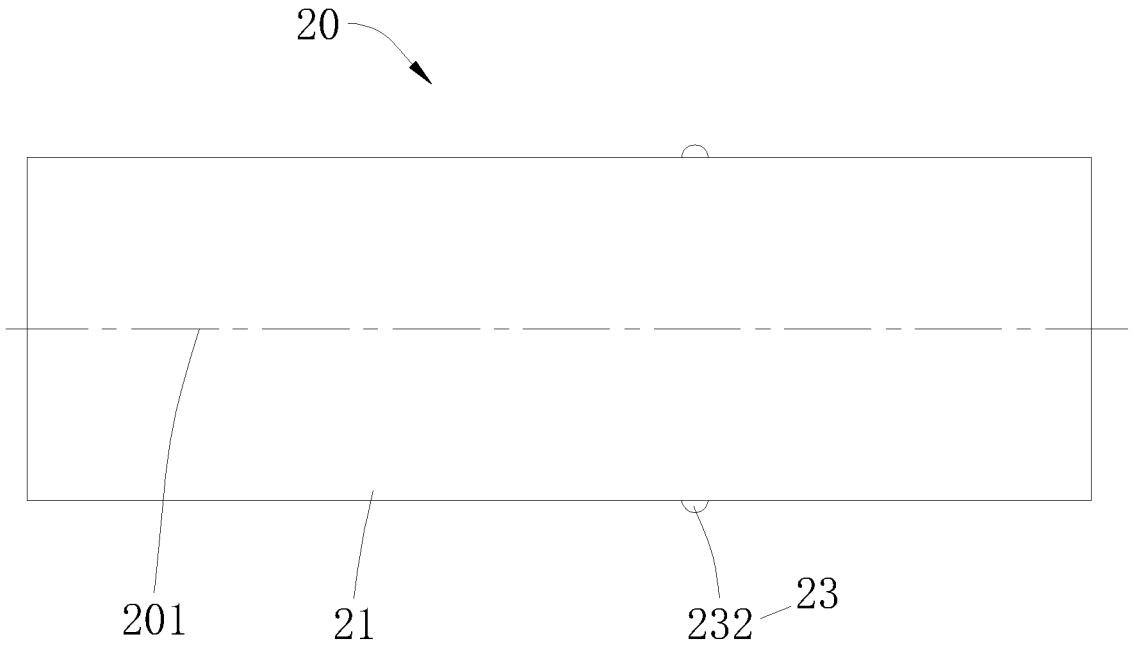
FIG. 4 is a schematic structural view of an exhaust pipe according to an embodiment of the present disclosure.

In an embodiment, as illustrated in FIG. 1 and FIG. 4, the positioning structure 23 may also be a rib ring 232 disposed on the straight pipe segment 21. The rib ring 232 is configured to position the depth of the insertion of the exhaust pipe 20 into the housing 11. The use of a structure of the rib ring 232 achieves a small size and low costs. It should be understood that, the positioning structure 23 may also be one or more positioning protrusions disposed on the outer peripheral surface of the straight pipe segment 21. The positioning protrusion is configured to position the depth of the insertion of the exhaust pipe 20 into the housing 11.

In an embodiment, when the positioning structure 23 is the rib ring 232, the rib ring 232 and the straight pipe segment 21 may be integrally formed to facilitate the processing and manufacturing. When the positioning structure 23 is the rib ring 232, the rib ring 232 and the straight pipe segment 21 are manufactured separately, and the rib ring 232 is then welded to the straight pipe segment 21.

In an embodiment, when the positioning structure 23 is the one or more positioning protrusions, the one more positioning protrusions and the straight pipe segment 21 may be integrally formed. That is, during manufacturing of the straight pipe segment 21, the positioning protrusions are formed on the outer peripheral surface of the straight pipe segment 21. When the positioning structure 23 are the positioning protrusions, the positioning protrusions may also be directly welded to the outer peripheral surface of the straight pipe segment 21.

Figure 5:
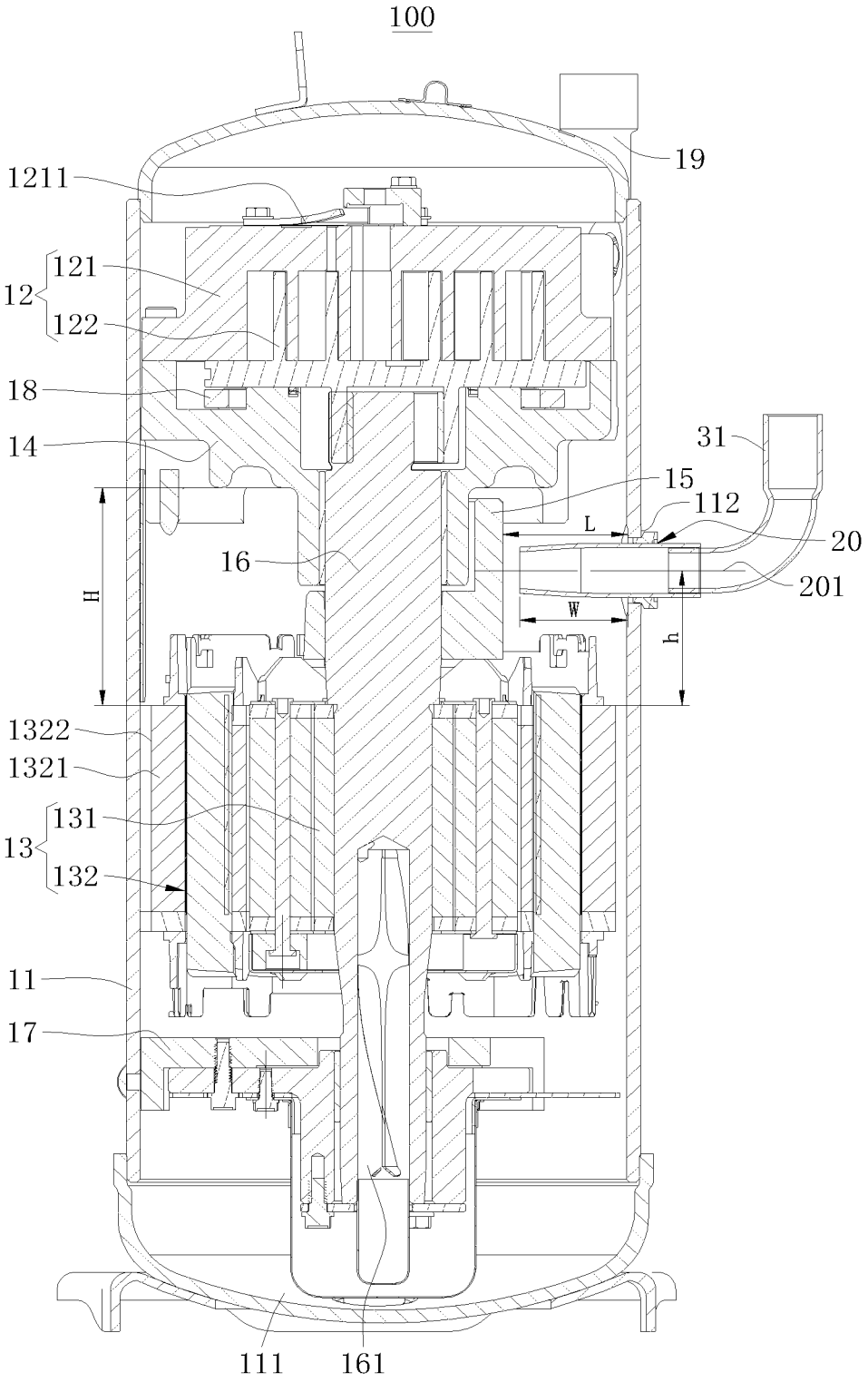
FIG. 5 is a schematic view of a cross-sectional structure of a scroll compressor according to an embodiment of the present disclosure.
Figure 6:
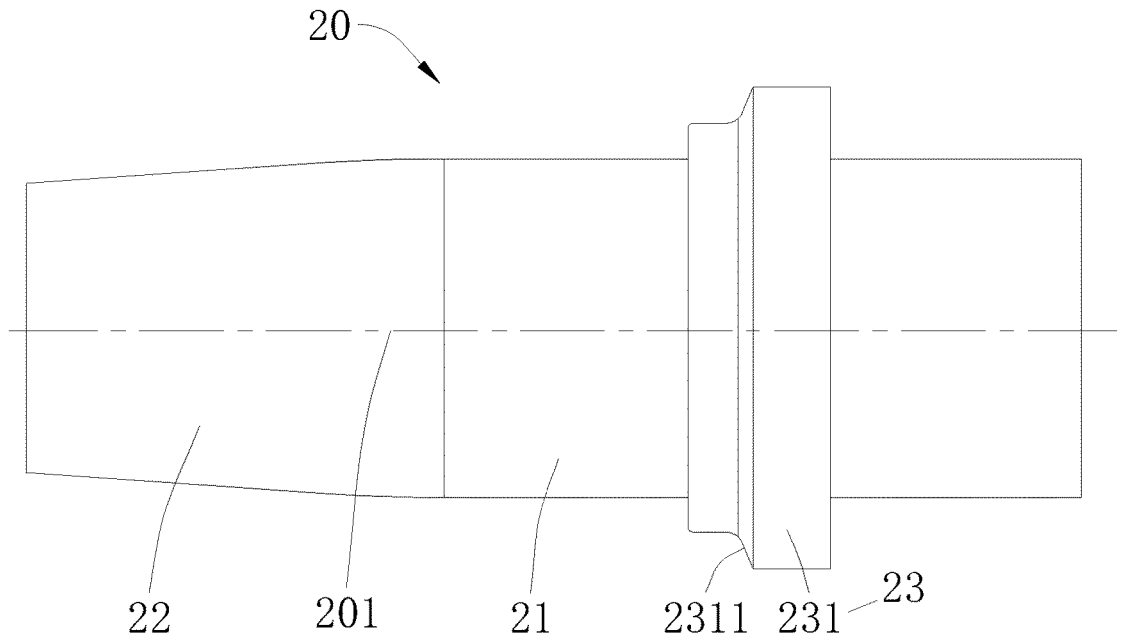
FIG. 6 is a schematic structural view of an exhaust pipe in FIG. 5.
Figure 7:
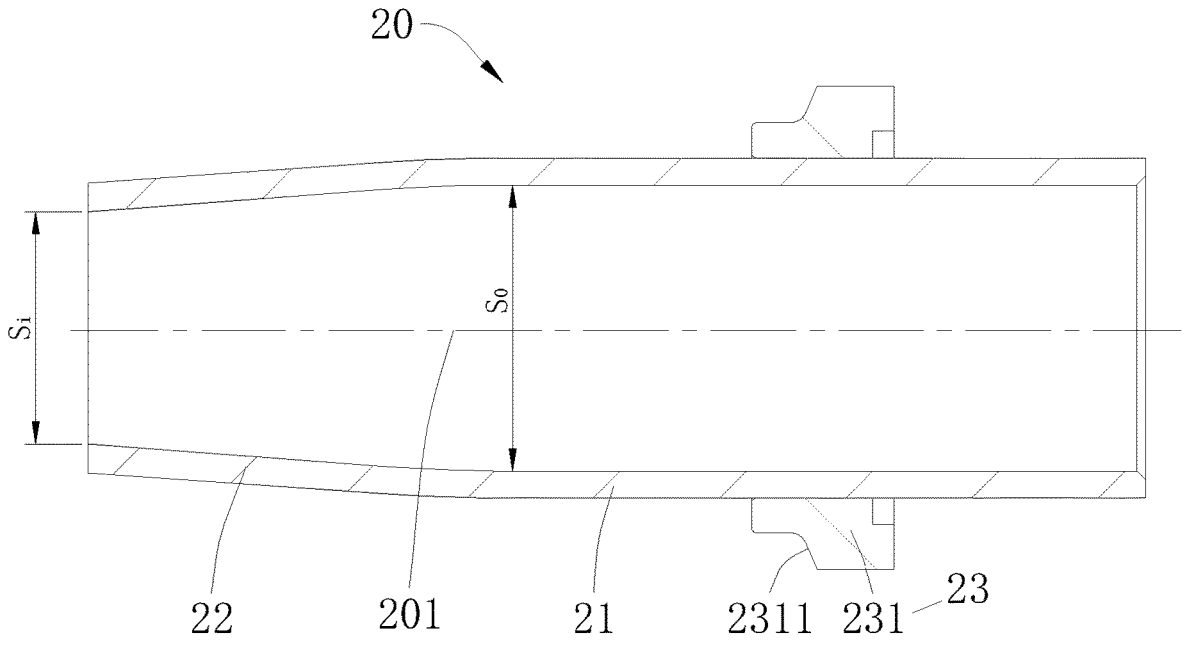
FIG. 7 is a schematic view of a cross-sectional structure of the exhaust pipe in FIG. 5.

Reference can be made to FIG. 5. FIG. 5 is a schematic view of a cross-sectional structure of the scroll compressor 100 according to an embodiment. FIG. 6 is a schematic structural view of the exhaust pipe 20 according to the embodiment. FIG. 7 is a schematic view of a cross-sectional structure of the exhaust pipe 20 according to the embodiment. A structure of the embodiment is a modification from that in FIG. 1. Differences between the scroll compressor 100 of the embodiment and the scroll compressor 100 illustrated in FIG. 1 are described below.

A segment of the exhaust pipe 20 adjacent to the crankshaft 16 is a tapered pipe segment 22. That is, the exhaust pipe 20 has the tapered pipe segment 22. The tapered pipe segment 22 is a segment of the exhaust pipe 20 adjacent to the crankshaft 16. An inner diameter of an end of the tapered pipe segment 22 adjacent to the crankshaft 16 is smaller than an inner diameter of another end of the tapered pipe segment 22. With the tapered pipe segment 22, some of the gas can be blocked from entering the exhaust pipe 20 in a case of a same volume of gas. Therefore, more the oil-gas mixture can be subject to the oil and gas separation by the main balancing block 15 and the housing 11 to improve the effect of the oil and gas separation.

In an embodiment, the end of the tapered pipe segment 22 adjacent to the crankshaft 16 has a cross-sectional area $S_i$, and the other end of the tapered pipe segment 22 facing away from the crankshaft 16 has a cross-sectional area $S_o$, where $0.50 \leq S_i/S_o \leq 1.00$. That is, the end of the tapered pipe segment 22 adjacent to the crankshaft 16 has a pipe opening area $S_i$, and the other end of the tapered pipe segment 22 facing away from the crankshaft 16 has a pipe opening area $S_o$. $S_i/S_o$ ranges from 0.50 to 1.00. For example, a value of $S_i/S_o$ may be 0.52, 0.55, 0.57, 0.62, 0.65, 0.67, 0.70, 0.72, 0.75, 0.77, 0.80, 0.82, 0.85, 0.87, 0.90, 0.92, 0.95, 0.97, 1.00, etc.

By setting $S_i/S_o$ to a range from 0.50 to 1.00 can ensure a good exhaust volume of the exhaust pipe 20, it is possible to ensure the high-pressure gas generated by the compression mechanism portion 12 to be well exhausted, and guarantee a small exhaust resistance. In addition, more the oil-gas mixture can be subject to the oil and gas separation by the main balancing block and the housing 11, which improves the effect of the oil and gas separation.

In an embodiment, as illustrated in FIG. 5, FIG. 6, and FIG. 7, the exhaust pipe 20 further includes the straight pipe segment 21 connected to the housing 11. The other end of the tapered pipe segment 22 facing away from the crankshaft 16 is connected to the straight pipe segment 21. That is, the exhaust pipe 20 includes the tapered pipe segment 22 and the straight pipe segment 21. The tapered pipe segment 22 is located at an end of the straight pipe segment 21 adjacent to the crankshaft 16 and is connected to the straight pipe segment 21. The straight pipe segment 21 is provided to facilitate the connection to the housing 11, which facilitates the connection to the housing 11 through welding.

In an embodiment, the positioning structure 23 is disposed on the straight pipe segment 21 and located on the outer side surface of the straight pipe segment 21. When the straight pipe segment 21 is inserted into the housing 11, the positioning structure 23 can provide stopping and positioning. That is, the positioning structure 23 can be configured to stop and position the outer surface of the housing 11 to restrict the depth of the insertion of the exhaust pipe 20 into the housing 11, which facilitates the assembly of the exhaust pipe 20.

In an embodiment, the positioning structure 23 may be the annular base 231 disposed on the straight pipe segment 21. When the exhaust pipe 20 is inserted into the housing 11, the annular base 231 abuts the outer surface of the housing 11 to position the depth of the insertion of the exhaust pipe 20 into the housing 11. The annular base 231 is connected to the outer surface of the housing 11 through welding to fixedly connect the exhaust pipe 20 to the housing 11, which facilitates the assembly and connection.

In an embodiment, the outer surface of the housing 11 includes the stamping welding flat surface 112, and the end surface 2311 of the annular base 231 adjacent to the housing 11 is the flat surface. In this way, during the assembly, the end surface of the annular base 231 adjacent to the housing 11 abuts the stamping welding flat surface 112 of the housing 11 to be better attached to the stamping welding flat surface 112, which facilitates the welding to the housing 11.

It should be understood that, when the outer surface of the housing 11 is the circular arc surface, the end surface of the annular base 231 adjacent to the housing 11 has the circular arc surface adapted to the outer surface of the housing 11. In this way, during the assembly, the end surface of the annular base 231 adjacent to the housing 11 is better attached to the outer surface of the housing 11, which facilitates the welding to the housing 11.

In an embodiment, the positioning structure 23 and the straight pipe segment 21 are integrally formed, which facilitates the processing and manufacturing and ensures sufficient connection strength between the positioning structure 23 and the straight pipe segment 21. For example, when the positioning structure 23 is the annular base 231, the annular base 231 and the straight pipe segment 21 are integrally formed.

It should be understood that, the positioning structure 23 may also be welded to the straight pipe segment 21. For example, when the positioning structure 23 is the annular base 231, the annular base 231 and the straight pipe segment 21 are manufactured separately, and the annular base 231 is welded to the straight pipe segment 21.

Figure 8:
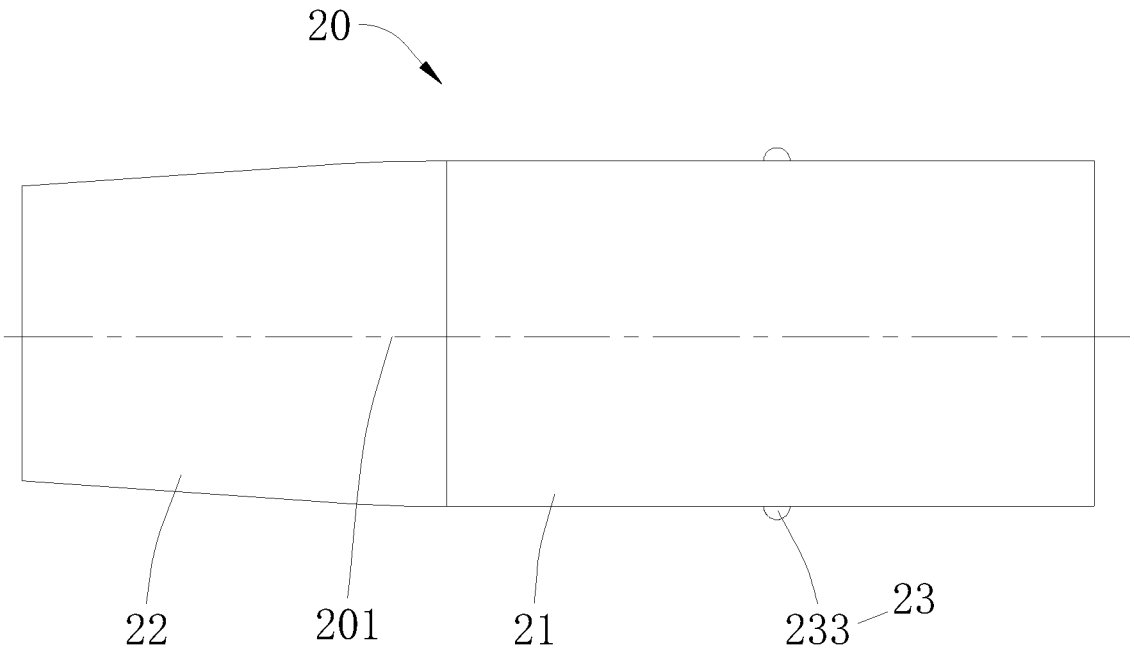
FIG. 8 is a schematic structural view of an exhaust pipe according to an embodiment of the present disclosure.

In an embodiment, as illustrated in FIG. 5 and FIG. 8, the positioning structure 23 may also be the rib ring 232 disposed on the straight pipe segment 21. The rib ring 232 is configured to position the depth of the insertion of the exhaust pipe 20 into the housing 11. It should be understood that the positioning structure 23 may also be one or more positioning protrusions disposed on the outer peripheral surface of the straight pipe segment 21. The positioning protrusion is configured to position the depth of the insertion of the exhaust pipe 20 into the housing 11.

In an embodiment, when the positioning structure 23 is the rib ring 232, the rib ring 232 and the straight pipe segment 21 may be integrally formed. When the positioning structure 23 is the rib ring 232, the rib ring 232 and the straight pipe segment 21 are manufactured separately, and the rib ring 232 is welded to the straight pipe segment 21.

In an embodiment, when the positioning structure 23 is the one or more positioning protrusions 233, the positioning protrusions 233 and the straight pipe segment 21 may be integrally formed. That is, during the manufacturing of the straight pipe segment 21, the positioning protrusions 233 are formed on the outer peripheral surface of the straight pipe segment 21. When the positioning structure 23 is the one or more positioning protrusions 233, the positioning protrusions 233 may also be directly welded to the outer peripheral surface of the straight pipe segment 21.

The oil-gas mixture discharged from the compression mechanism portion 12 of the scroll compressor 100 according to the present disclosure can be subject to the sufficient oil and gas separation to realize a low oil content in the exhaust of the scroll compressor 100, which effectively reduces the oil circulation rate and ensures the reliability of the scroll compressor 100. The scroll compressor 100 may be applied in an air conditioning device, an air compression device and other devices.

The embodiments of the present disclosure further provide an air conditioning system including the scroll compressor 100 as described in any of the above-mentioned embodiments. The air conditioning system of the embodiments of the present disclosure uses the scroll compressor 100 of the above-mentioned embodiments and has the technical effect of the above-mentioned scroll compressor 100, and thus details thereof will be omitted herein.

While several embodiments of the present disclosure have been described above, the present disclosure is not limited to these embodiments. For those skilled in the art, various changes and variations can be made to the present disclosure. Any modification, equivalent substitution, improvement, or the like made within the spirit and principles of the present disclosure shall fall within the scope of the appended claims of the present disclosure.

What is claimed is:

1. A scroll compressor comprising a housing, a compression mechanism portion, a main frame, a motor, a crankshaft, a main balancing block, and an exhaust pipe, wherein:

the main frame is located between the compression mechanism portion and the motor;

the main balancing block is arranged around the crankshaft and located between the motor and the main frame;

the motor comprises a rotor and a stator;

the crankshaft passes through the rotor and is connected to the compression mechanism portion;

the stator is mounted in the housing and comprises an iron core mounted in the housing;

an end of the exhaust pipe extends into the housing towards an outer peripheral wall of the main balancing block, and is located between the main frame and the motor;

in an axial direction of the crankshaft, a lower end surface of the main frame is located at a distance H from an upper end surface of the iron core, and a central axis of the exhaust pipe is located at a distance h from the upper end surface of the iron core, where $0.17 \leq h/H \leq 0.62$; and in a radial direction of the housing, the exhaust pipe extends into the housing at a depth W, and the outer peripheral wall of the main balancing block is located at a distance L from an inner wall of the housing, where $0.47 \leq W/L \leq 0.93$.

2. The scroll compressor according to claim 1, wherein a segment of the exhaust pipe adjacent to the crankshaft is a tapered pipe segment, an inner diameter of an end of the tapered pipe segment adjacent to the crankshaft being smaller than an inner diameter of another end of the tapered pipe segment.

3. The scroll compressor according to claim 2, wherein the end of the tapered pipe segment adjacent to the crankshaft has a cross-sectional area $S_i$, and the other end of the tapered pipe segment facing away from the crankshaft has a cross-sectional area $S_o$, where $0.50 \leq S_i/S_o < 1.00$.

4. The scroll compressor according to claim 1, wherein the exhaust pipe comprises a straight pipe segment penetrating the housing.

5. The scroll compressor according to claim 4, wherein a positioning structure is disposed on the straight pipe segment, the positioning structure being configured to stop and position the exhaust pipe to restrict the depth of extension of the exhaust pipe into the housing, and the positioning structure being located on an outer peripheral surface of the straight pipe segment.

6. The scroll compressor according to claim 5, wherein:

the positioning structure is a rib ring disposed on the straight pipe segment.

7. The scroll compressor according to claim 6, wherein the positioning structure is an annular base disposed on the straight pipe segment, the annular base being connected to an outer surface of the housing through welding.

8. The scroll compressor according to claim 7, wherein an end surface of the annular base adjacent to the housing has a circular arc surface adapted to the outer surface of the housing.

9. The scroll compressor according to claim 7, wherein:

the outer surface of the housing has a stamping welding flat surface; and an end surface of the annular base adjacent to the housing has a flat surface adapted to the stamping welding flat surface of the housing.

10. The scroll compressor according to claim 5, wherein:

the positioning structure and the straight pipe segment are integrally formed.

11. The scroll compressor according to claim 5, wherein the positioning structure is welded on the straight pipe segment.

12. The scroll compressor according to claim 5, wherein:

the positioning structure comprises one or more positioning protrusions disposed on the outer peripheral surface of the straight pipe segment.

13. The scroll compressor according to claim 12, wherein the positioning structure is an annular base disposed on the straight pipe segment, the annular base being connected to an outer surface of the housing through welding.

14. The scroll compressor according to claim 13, wherein an end surface of the annular base adjacent to the housing has a circular arc surface adapted to the outer surface of the housing.

15. The scroll compressor according to claim 13, wherein:

the outer surface of the housing has a stamping welding flat surface; and an end surface of the annular base adjacent to the housing has a flat surface adapted to the stamping welding flat surface of the housing.

16. An air conditioning system comprising the scroll compressor according to claim 1.

* * * * *